US011147329B2

(12) United States Patent
Gholson

(10) Patent No.: US 11,147,329 B2
(45) Date of Patent: Oct. 19, 2021

(54) INTERCHANGEABLE HAT SYSTEM

(71) Applicant: Arthur Gholson, Orange, OH (US)

(72) Inventor: Arthur Gholson, Orange, OH (US)

( * ) Notice: Subject to any disclaimer, the term of this patent is extended or adjusted under 35 U.S.C. 154(b) by 573 days.

(21) Appl. No.: 15/541,602

(22) PCT Filed: Jan. 6, 2016

(86) PCT No.: PCT/US2016/012325
§ 371 (c)(1),
(2) Date: Jul. 5, 2017

(87) PCT Pub. No.: WO2016/112098
PCT Pub. Date: Jul. 14, 2016

(65) Prior Publication Data

US 2018/0000180 A1 Jan. 4, 2018

Related U.S. Application Data

(60) Provisional application No. 62/100,171, filed on Jan. 6, 2015.

(51) Int. Cl.
*A42B 1/08* (2006.01)
*A42B 1/0184* (2021.01)
*A42B 1/205* (2021.01)

(52) U.S. Cl.
CPC ..... *A42B 1/0184* (2021.01); *A42B 1/205* (2013.01)

(58) Field of Classification Search
CPC ..... A42B 1/064; A42B 1/205
See application file for complete search history.

(56) References Cited

U.S. PATENT DOCUMENTS 5,359,733 A * 11/1994 Brannon ..... A42B 1/248 2/195.1
5,373,586 A * 12/1994 Brosnan ..... A42B 1/248 2/195.1
5,437,062 A * 8/1995 Douglas ..... A42B 1/064 2/10
5,471,684 A * 12/1995 Casale ..... A42B 1/064 2/10
5,533,211 A * 7/1996 Mehrens ..... A42B 1/064 2/181

(Continued)

OTHER PUBLICATIONS

Patent Cooperation Treaty (PCT), International Search Report and Written Opinion for Application PCT/US2016/012325 filed Jan. 6, 2016, dated Mar. 16, 2016, International Searching Authority, US.

*Primary Examiner* — Richale L Quinn
(74) *Attorney, Agent, or Firm* — McDonald Hopkins LLC

(57) ABSTRACT

Provided is a hat system including a crown having a headband and a bill. A connection mechanism may slidingly attach the bill and the crown. The connection mechanism includes a bill portion and a crown portion. The bill portion may include a channel and the crown portion may include at least one rail wherein the channel is configured to slidingly receive the rail to connect the bill to the crown. Additionally, the crown portion may include a first receiver track and the bill portion may include the second receiver track wherein the first receiver track may slidingly receive a portion of the crown portion and the second receiver track may slidingly receive a portion of the bill portion to connect the bill to the crown.

3 Claims, 15 Drawing Sheets

(56) References Cited

U.S. PATENT DOCUMENTS

| | | | | | |
|---|---|---|---|---|---|
| 5,613,246 | A * | 3/1997 | Alexander | A42B 1/064 | 2/10 |
| 5,657,490 | A * | 8/1997 | Edmark | A42B 1/201 | 2/171.03 |
| 5,715,534 | A * | 2/1998 | Mobley | A42B 1/064 | 2/10 |
| 5,870,772 | A * | 2/1999 | Sprouse | A42B 1/064 | 2/10 |
| 6,070,270 | A * | 6/2000 | De La Torre | A42B 1/064 | 2/10 |
| 6,260,208 | B1 * | 7/2001 | Wang | A42B 1/062 | 2/171.03 |
| 6,263,508 | B1 * | 7/2001 | Davis | A42B 1/064 | 2/10 |
| 6,473,907 | B1 * | 11/2002 | Harwood | A42B 1/064 | 2/12 |
| 6,671,886 | B1 * | 1/2004 | Reitz | A41G 7/00 | 2/206 |
| 6,789,267 | B2 * | 9/2004 | Ahn | A42B 1/064 | 2/175.1 |
| 7,225,475 | B2 * | 6/2007 | Cho | A42B 1/02 | 2/12 |
| 7,240,373 | B2 * | 7/2007 | Ahn | A42B 1/064 | 2/175.1 |
| 9,451,801 | B2 * | 9/2016 | Bryan | A42B 3/04 | |
| 9,498,015 | B2 * | 11/2016 | Kim | A42B 3/227 | |
| 9,700,107 | B1 * | 7/2017 | de Andrade | A43C 11/12 | |
| 9,980,528 | B2 * | 5/2018 | Reinhart | A42B 1/064 | |
| 10,104,927 | B2 * | 10/2018 | Olcese | A42B 1/22 | |
| 10,219,569 | B2 * | 3/2019 | Olivera, II | A42B 1/062 | |
| 2004/0040067 | A1 * | 3/2004 | Pong | A42B 1/064 | 2/195.2 |

* cited by examiner

C-C

INTERCHANGEABLE HAT SYSTEM

CROSS-REFERENCE TO RELATED APPLICATIONS

This application claims priority to and is a national phase entry application of international application number PCT/US2016/012325 filed Jan. 6, 2016 titled INTERCHANGEABLE HAT SYSTEM which claims priority to U.S. provisional patent application No. 62/100,171 filed on Jan. 6, 2015 titled INTERCHANGEABLE HAT SYSTEM each are incorporated herein by reference in their entireties.

FIELD OF INVENTION

The present disclosure generally relates to a system for interchanging hats. More particularly, the disclosure relates to a system of wearable hat covers and hat bills that may be mixed and matched as desired by a wearer.

BACKGROUND

It is a fashion trend to wear baseball style caps, especially when it comes to preventing the sun and its damaging rays from hitting a person's face. Many people wear many different styles and colors of hats and keeping many different hat combinations are both prohibitively expensive and storage and accessibility becomes a major issue.

A typical baseball style cap includes a crown, a headband and a bill or brim. The crown is usually made with multiple panels that are conjoined along a plurality of seams that come together at an apex. The headband is positioned about an inner circumference of an open portion of the crown, opposite the apex, while the part extending perpendicular from the crown and headband is the bill.

Hats are typically sold as once piece that prevents the wearer from interchanging a bill and crown combination. To have or wear different styles of hats requires separately purchasing numerous different hats with different colors, logos, styles, etc. Therefore, there is a need for a hat system that allows the wearer greater customization related to bill and crown style and color combinations.

SUMMARY

This disclosure relates to the interchangeability of the bill and/or crown portion while maintaining the style, purpose and function of the remaining parts. The disclosed invention provides the fashion industry and hat wearer with a product that has both aesthetic qualities and functional abilities to suit the ever changing desires of the general public in terms of hats.

Provided is a hat system including a crown having a headband and a bill. A connection mechanism slidingly attaches between the bill and the crown. The connection mechanism includes a bill portion and a crown portion. The bill portion may include a channel and the crown portion may include at least one rail wherein the channel is configured to slidingly receive the rail to connect the bill to the crown. The rail may include a plurality of rail heads positioned in elongated alignment along the bill portion.

In one embodiment, the bill portion may include a first rail member and a second rail member. The crown portion may include a first receiving member and a second receiving member wherein the first receiving member may slidingly receive the first rail member and the second receiving member may slidingly receive the second rail member to connect the bill to the crown. The crown may include a plurality of sections attached to each other along seams, the crown portion may be attached to a front portion of the crown such that additional reinforcement of the crown portion is provided along the seams between the sections. The first rail member and a second rail member may further include an elongated slot opening along a side portion of the first receiving member and an elongated slot opening along a bottom portion of the second receiving member such that the first and second rail portions may be supported at least partially within the elongated slot openings.

In another embodiment, provided is an interchangeable hat system that includes a crown, a bill and a connection mechanism between the bill and the crown wherein the connection mechanism includes a bill portion and a crown portion. The crown portion may include a first receiver track and the bill portion may include a second receiver track wherein the first receiver track slidingly receives a portion of the bill portion and the second receiver track slidingly receives a portion of the crown portion to connect the bill to the crown. The crown portion may include an arm and an attachment member that define the first receiver track, and the bill portion may include a wall and an attachment portion that define a second receiver track. The crown portion includes a bead portion and the bill portion includes a bead portion. The crown portion may also include at least one hinge member for selectively biasing between an open position and a closed position relative to the first receiver track. The hinge member may include a ridge.

The crown may include a headband with a flap, the flap may bias between a closed position to generally cover the connection mechanism and an open position to allow the bill to be connected or disconnected from the crown. The headband may be attached to at least one retaining strap to allow the flap to bias between the open position to the closed position.

BRIEF DESCRIPTION OF THE DRAWINGS

Operation of the invention may be better understood by reference to the following detailed description taken in connection with the following illustrations, wherein.

DETAILED DESCRIPTION

Reference will now be made in detail to embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

Figure 1:
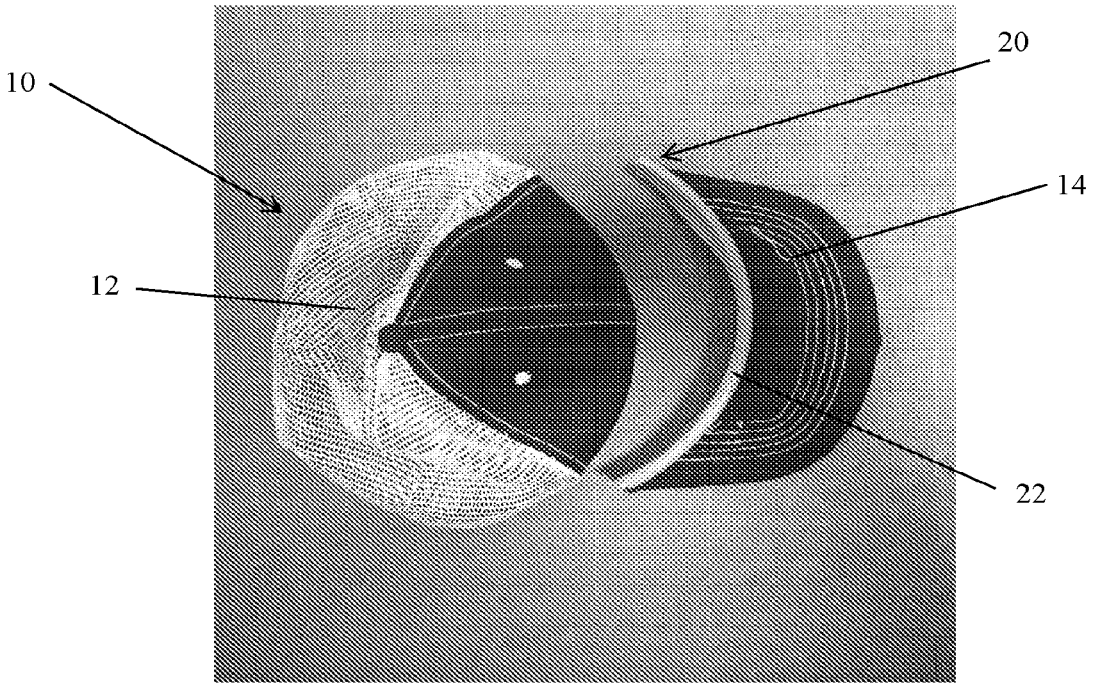
FIG. 1 is a plan view of an embodiment of a hat system of the present disclosure wherein a bill is separate from a crown.

With reference to the an embodiment of the invention as shown in FIG. 1, hat 10 includes a crown 12 made of various types and colors of fabric and a bill 14, although it should be noted that the invention is not limited to a particular crown or bill shape or material and in fact works with any number of crown and bill shapes, conventional materials and relative rigidity, including very flexible or "floppy" crowns and brims. Further, the crown does not have to be an enclosed crown as illustrated in the various embodiments. Rather, in embodiments, the crown may be open as is found in visors.

Figure 4:
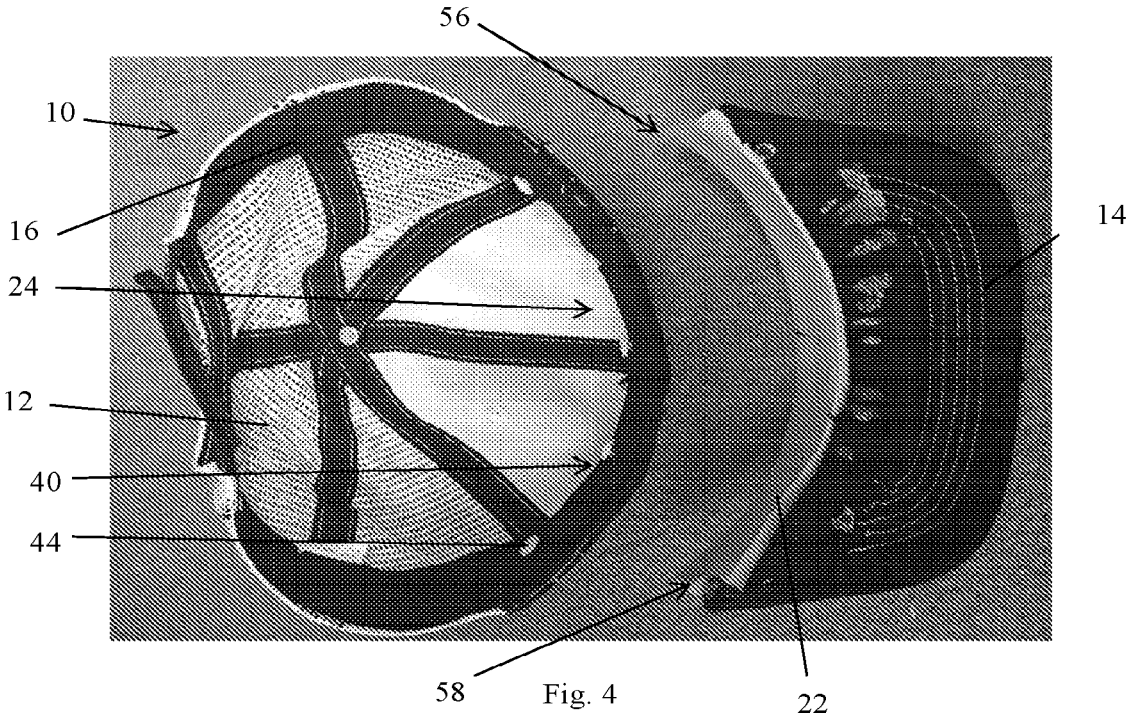
FIG. 4 is an underside view of the hat system of FIG. 1 wherein the bill is separate from the crown.
Figure 7:
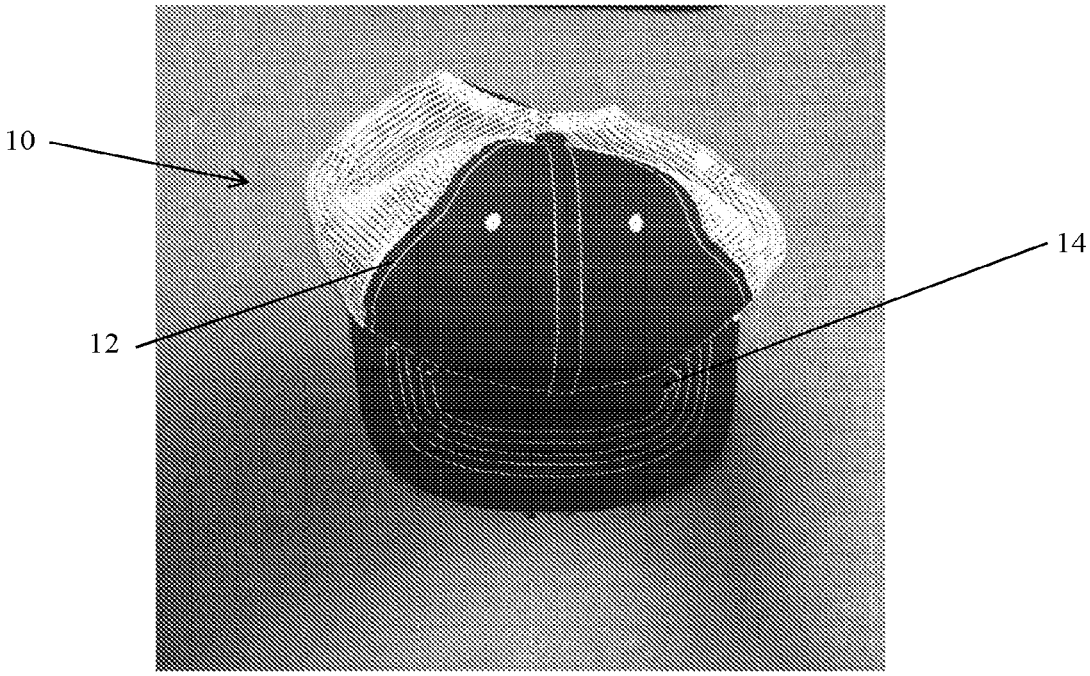
FIG. 7 is a top view of the hat system of FIG. 1 wherein the bill is attached to the crown.
Figure 8:
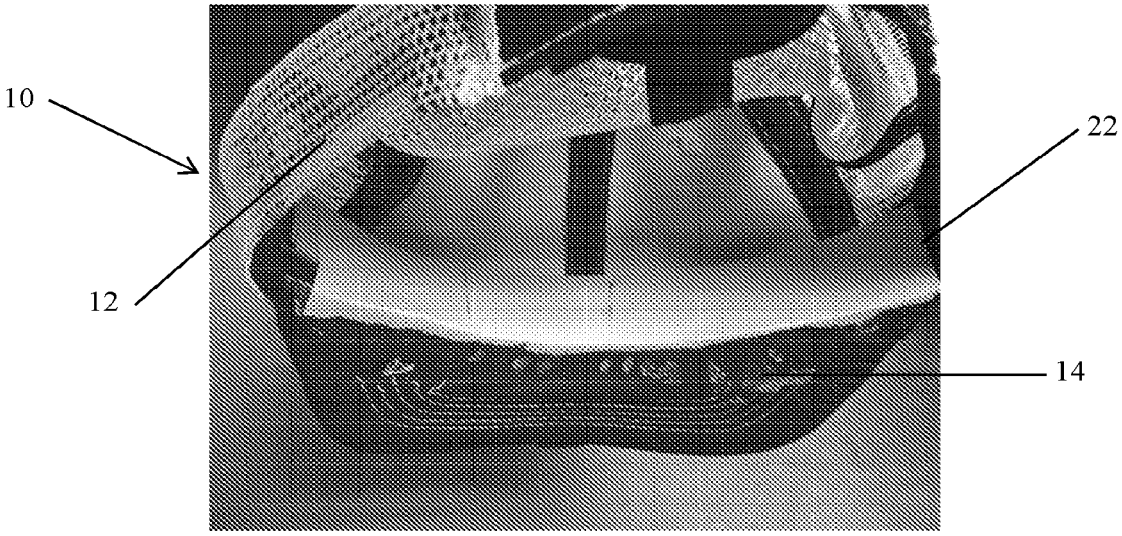
FIG. 8 is a bottom view of the hat system of FIG. 1 wherein the bill is attached to the crown.

Referring to FIGS. 4 and 7, inside the crown 12 is a headband 16 that circumscribes at least a substantial portion and preferably the entire interior circumference of the crown 12. Headband 16 may take the form of any conventional headband material such as leather or fabric or may be a full or partial interior lining for the crown 12. Headband 16 is attached to the crown 12 along its circumference at least at a seam line 18 by stitching, permanent adhesive or the like, as is well known in the art. The lower edges of both the crown 12 and the headband 16 preferably are hemmed along the seam line 18 to improve appearance and to eliminate unraveling of the fabrics.

Generally, the headband 16 extends within a cavity defined by the crown 12 from the lower edge such that the headband 16 and crown define a slight accessible space there between. A connection mechanism 20 is provided along a front portion of the crown 12 and a portion of the bill 14 according to the present disclosure. The connection mechanism 20 may include a bill portion 22 and a crown portion 24. The crown portion 24 may be at least partially within the slight assessable space between the crown 12 and the headband 16 while the bill portion 22 extends in a general transverse direction from a front edge 26 of the bill 14. The connection mechanism 20 may be generally rounded relative to the conventional shapes of baseball hat crowns and bills to allow for a comfortable fit on the head of the wearer. The headband 16 may be reinforced with additional fabric, threads, seams, or ridges to provide structural support to the connection mechanism 20.

Figure 2:
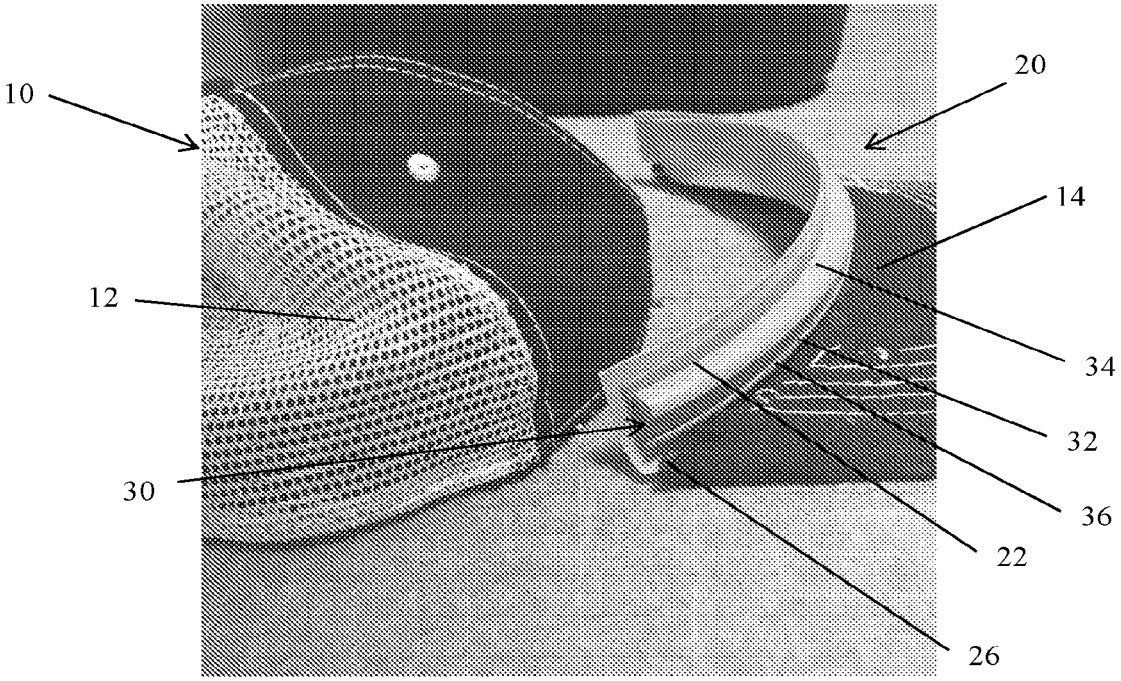
FIG. 2 is a side view of the hat system of FIG. 1.
Figure 3:
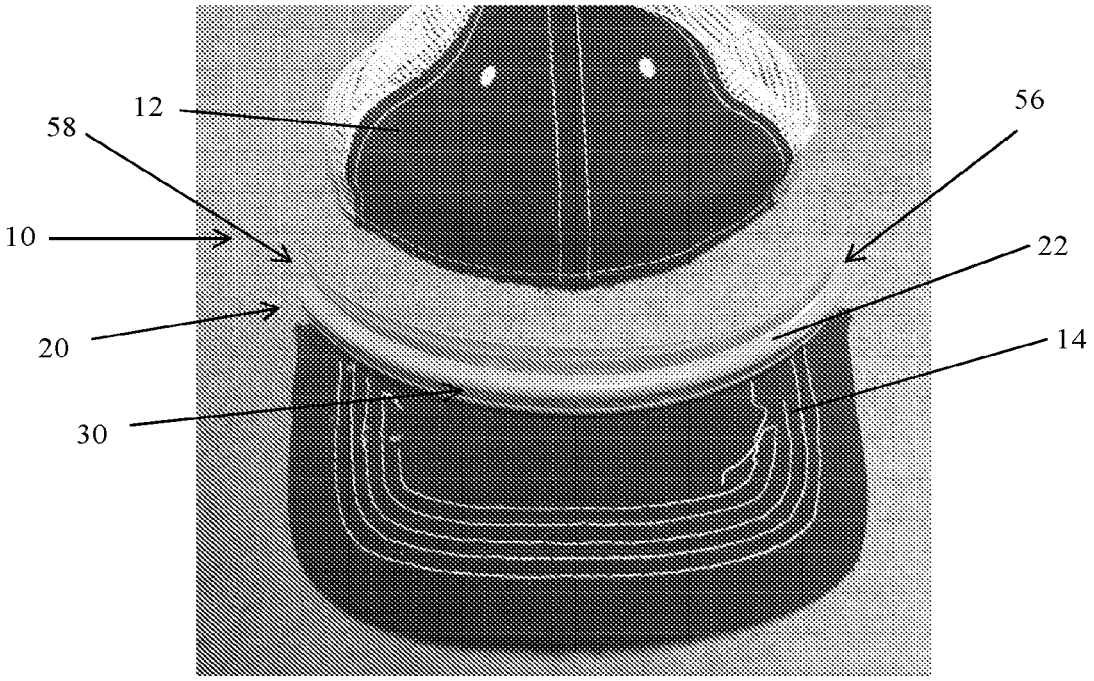
FIG. 3 is a front view of the hat system of FIG. 1.

As shown in FIGS. 2, 3, and 4, the bill 12 includes the bill portion 22 of the connection mechanism 20 as it extends upwardly from the front edge 26 of the bill 12. The bill portion 22 may include a receiver track 30 that is configured to be slidingly attached to the crown portion 24 of the connection mechanism 20. The connection mechanism 20 may include female and male interlocking parts which includes a channel 32 and a rail 40 (FIGS. 4 and 5), respectively.

As illustrated by FIG. 2, the channel 32 may include an upper flange 34 and a lower flange 36 that are shaped to define the channel 32. The upper flange 34 and lower flange 36 may include a similar length and extend along the bill portion 22 and be made of a flexible semi-rigid material such an extruded plastic, polyvinyl chloride, or PVC. The channel 32 may be adhesively fixed to the bill portion 22 or may be fixed with fasteners.

Figure 5:
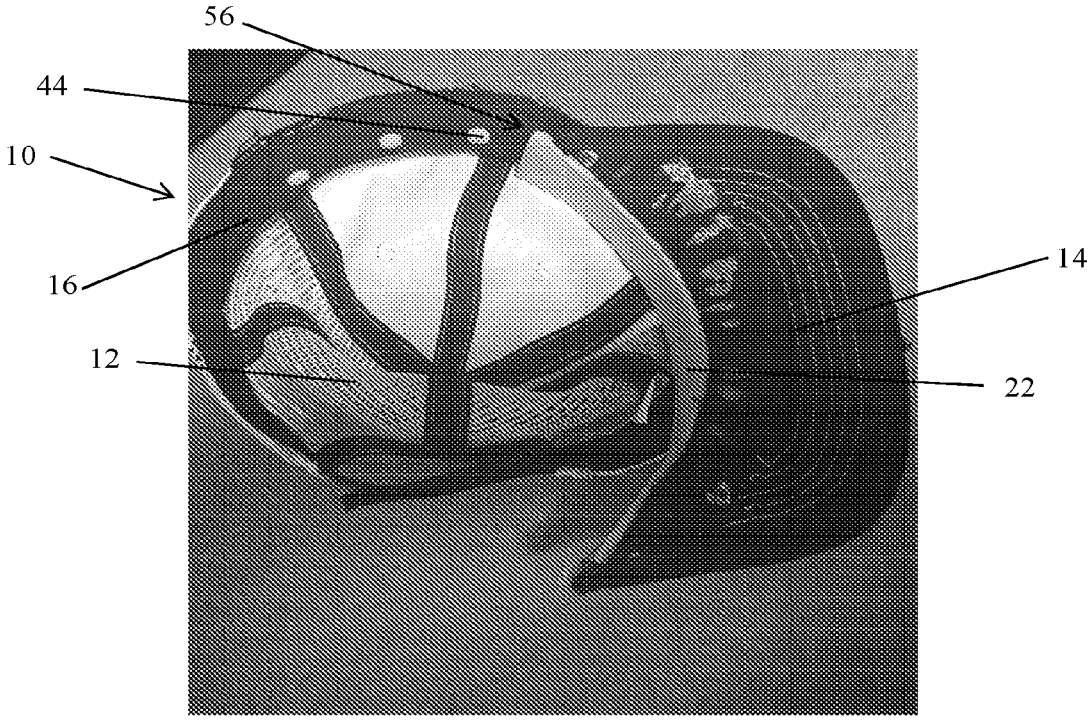
FIG. 5 is an underside view of the hat system of FIG. 1 wherein the bill is at least partially attached to the crown.
Figure 6:
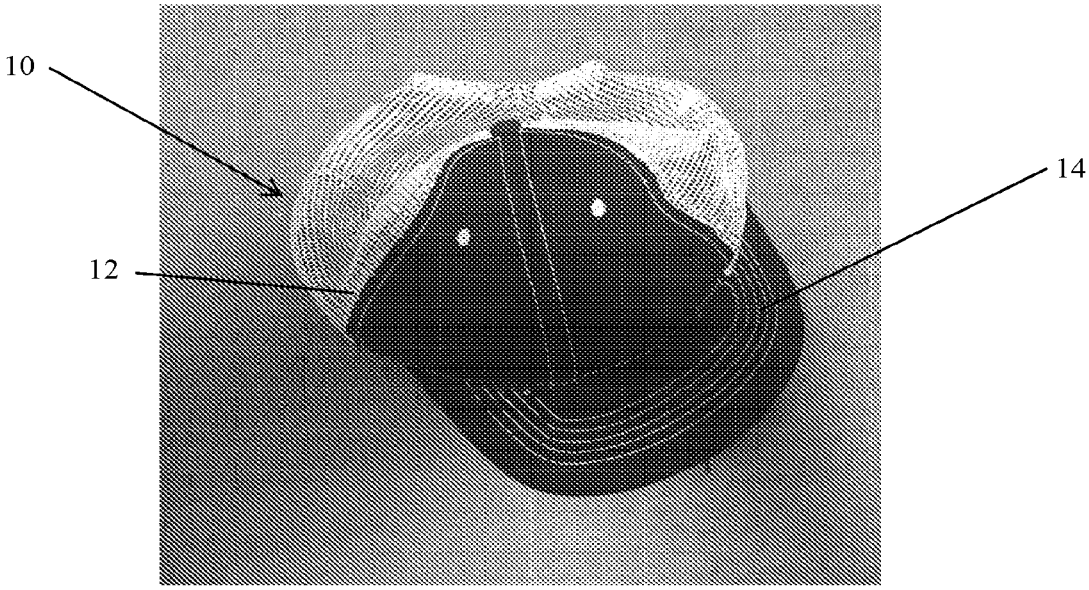
FIG. 6 is a top view of the hat system of FIG. 1 wherein the bill is at least partially attached to the crown.

The headband 16 may support the crown portion 24 of the connecting member 20 therein. In one embodiment, as illustrated by FIGS. 2 and 4, the crown portion 24 includes an elongated brim rail 40 positioned between the headband 16 and the crown 12 along a front portion of the crown 14. The brim rail 40 may include the rail (not shown) that is configured to be slidingly received within the channel 32 of the receiver track 30 of the bill portion 22. The rail may extend through the headband 16 to be configured to be received within the channel 32. The rail may be a continuous member (not shown) that extends along the elongated brim rail 40. In another embodiment, the brim rail 40 may include a plurality of rail heads 44 that are spaced apart from one another and extend from the brim rail 40 through the headband 16 to be received within the channel 32. The rail heads 44 may have a generally T shaped cross section to be able to slidingly fit within the channel 32. FIGS. 4 and 5 illustrate how the channel 32 of the bill portion 22 may be slidingly received along the plurality of rail heads 44. FIGS. 6 and 7 illustrate that the brim 14 may slide relative to the crown 12 to be placed in alignment with the front portion of the crown 12.

The bill portion 22 may include a stop member (not shown) that would prevent any further sliding of the bill portion 22 relative to the crown portion 24. The stop member may be positioned at a first end 56 of the bill portion 22. A locking mechanism (not shown) such as a latch, hook and loop, button or detent and recess, may be used to lock the bill portion 22 and the crown portion 24 to one another such that the bill 14 does not unintentionally slide relative to the crown 12. The locking mechanism may be positioned at a second end 58 of the bill portion 22 or the crown portion 24 such that the second end 58 is opposite from the first end 56. Optionally, either the stop member or the locking mechanism may be positioned on either the bill portion 22 or the crown portion 24 and this disclosure is not limited as to the position of these features.

The connection mechanism 20 allows the bill 14 and the crown 12 to be selectively attached such that the wearer may interchange either the crown 12 or the bill 14 with other colors, shapes, fashions of crowns or bills. Because the connection mechanism 20 is positioned between the lining or headband 16 and the bill portion 22, there is a smooth continuous gliding motion, and the mechanism never touches the head of the wearer. In this embodiment, the channel 32 is affixed to bill 14 and the rail is affixed to the crown 12, it also is possible for the channel 32 to be affixed to the crown 12 and the rail to be affixed to the bill 14.

An alternative embodiment of the disclosure is shown in FIGS. 9-12 to illustrate generally that the connection mechanism 20 may include various structural members to attach the bill 14 to the crown 12. In this embodiment, the hat 100 includes a crown 112 made of various types and colors of fabric and a bill 114, although it should be noted that the invention is not limited to a particular crown or bill shape or material and in fact works with any number of crown and bill shapes, conventional materials and relative rigidity, including very flexible or "floppy" crowns and brims.

Figure 9:
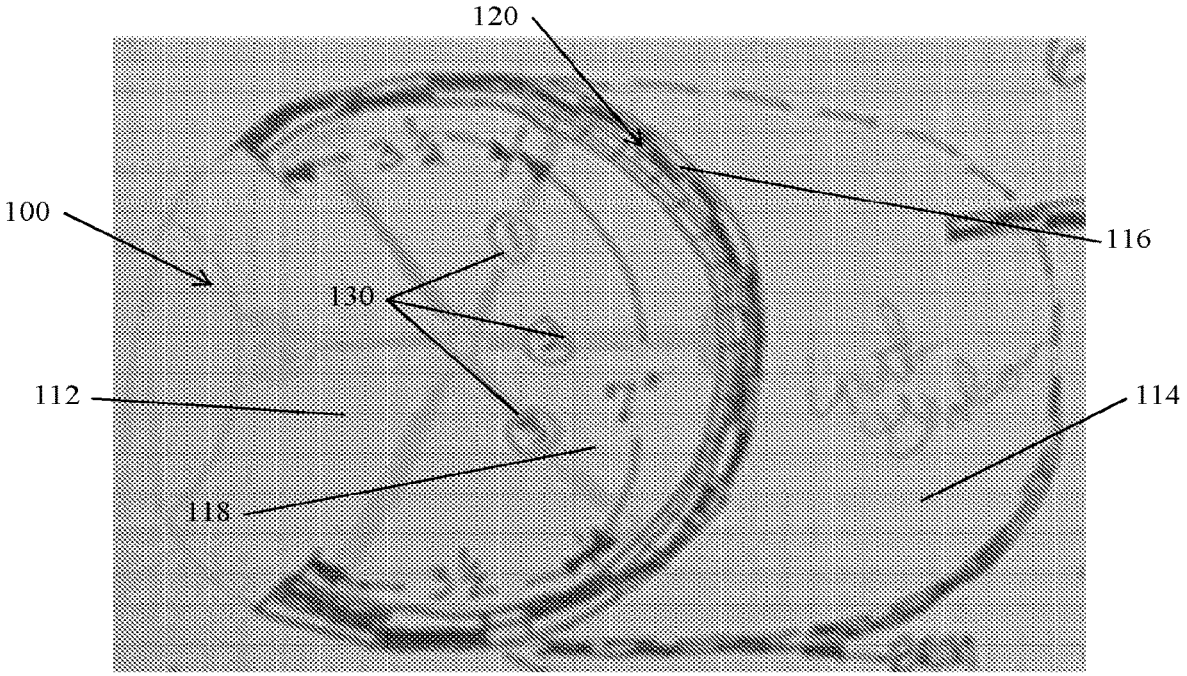
FIG. 9 is a schematic view of embodiments of the hat system wherein the bill is attached to the crown.

Referring to FIG. 9, inside the crown 112 is a headband 116 that circumscribes at least a substantial portion of the crown 112. Headband 116 may take the form of any conventional headband material such as leather or fabric or may be a full or partial interior lining for the crown 112. Headband 116 is attached to the crown 12 along its circumference at least at a seam line by stitching, permanent adhesive or the like, as is well known in the art. The lower edges of both the crown 112 and the headband 116 preferably are hemmed along the seam line to improve appearance and to eliminate unraveling of the fabrics. In one embodiment, the headband 116 extends about 14 inches about an interior circumference of the crown 112. However, the headband 116 may also extend about the entire interior circumference of the crown 112 to be fitted to a wearers head.

Generally, the headband 116 extends within a cavity defined by the crown 112 from the lower edge such that the headband 116 and crown define a slight accessible space there between. In this embodiment, a connection mechanism 120 is provided along a front portion of the crown 112 and a portion of the bill 114 according to the present disclosure. The connection mechanism 120 may include a bill portion 122 and a crown portion 124. The crown portion 124 may be at least partially within the slight assessable space between the crown 112 and the headband 116 while the bill portion 122 extends in a general transverse direction from a front edge of the bill 114. Alternatively, the crown portion 124 may extend inwardly from the headband 116 towards the cavity defined by the crown 112. The connection mechanism 120 may be generally rounded relative to the conventional shapes of baseball hat crowns and bills to allow for a comfortable fit on the head of the wearer. The headband 116 may be reinforced with additional fabric, threads, seams, or ridges to provide structural support to the connection mechanism 120.

The bill portion 122, and the crown portion 124 may extend about a portion of the circumference of the crown 112. In one embodiment, the connection mechanism 120 extends about 7 inches along the circumference of the crown 112 while the headband 116 extends about 3.5 inches from either side of the connection mechanism 120.

In one embodiment, the crown 112 may include a plurality of sections 118 wherein each section is connected to each other and terminates at an apex at a top portion of the crown 112. The sections 118 are connected along seams 130 wherein there may be two sections 118 along the front portion of the hat 100 that are to align with the bill 114. The two sections 118 along the front portion may include three seams 130 that provide structural reinforcement to the connection mechanism. Additional reinforcement may include additional stitches between the connection mechanism 120, the headband 116 and the crown 112 along these three seams 130.

Figure 10:
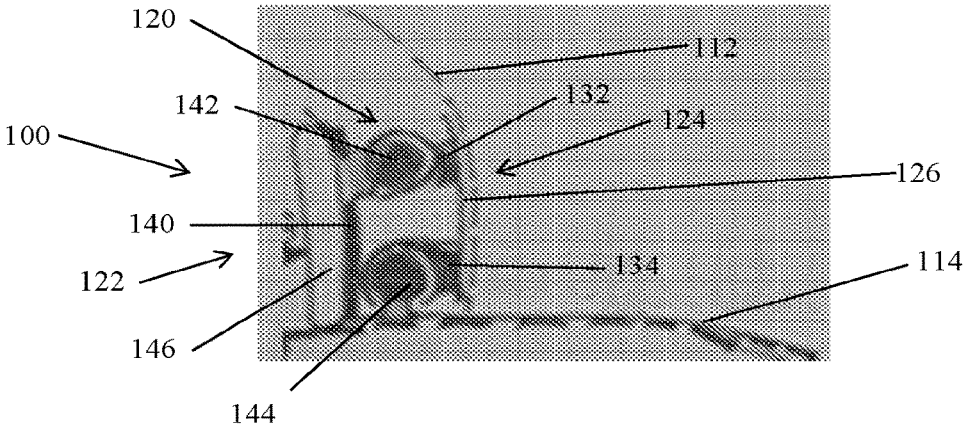
FIG. 10 is a schematic cross-sectional view of the hat system of FIG. 9.
Figure 11:
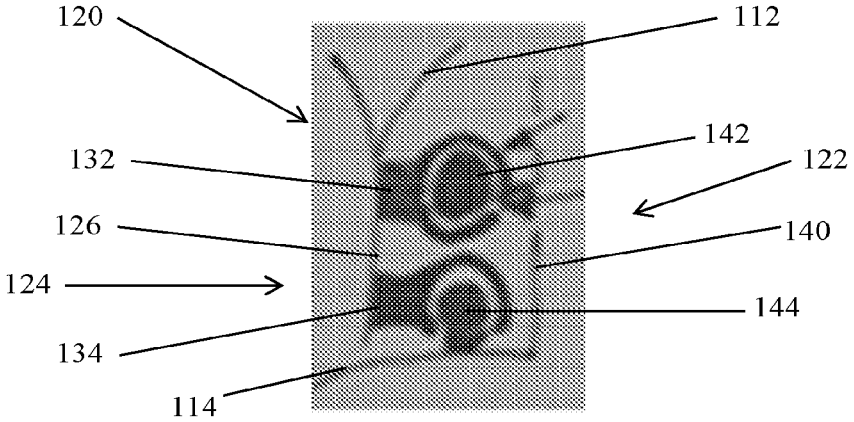
FIG. 11 is a schematic cross-sectional view of an attachment device of the hat system of FIG. 9.
Figure 12:
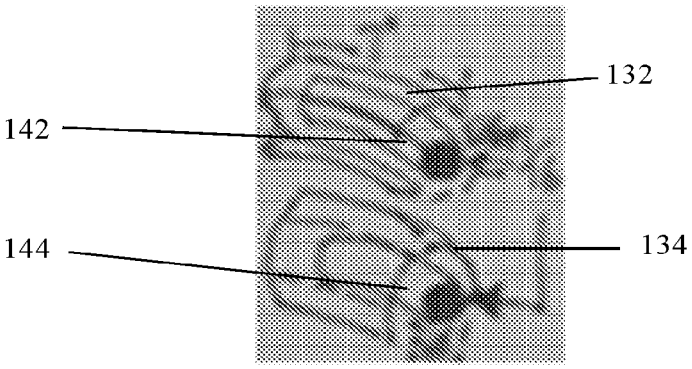
FIG. 12 is a perspective schematic view of the attachment device of the hat system of FIG. 9.
Figure 13:
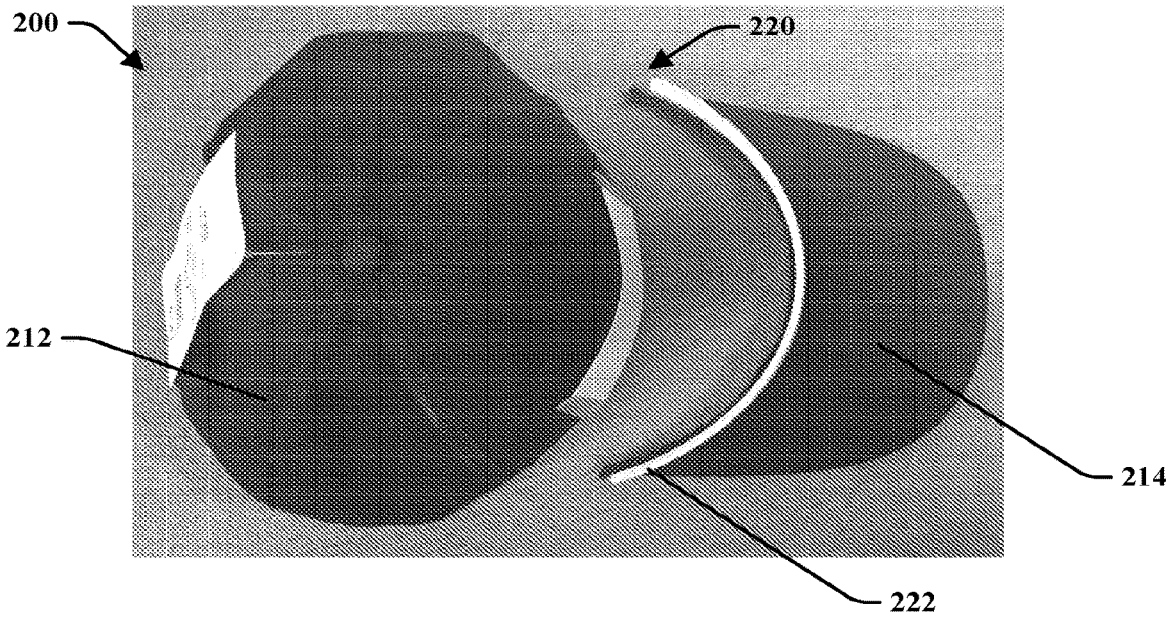
FIG. 13 is a plan view of another embodiment of a hat system of the present disclosure wherein a bill is separate from a crown.
Figure 14:
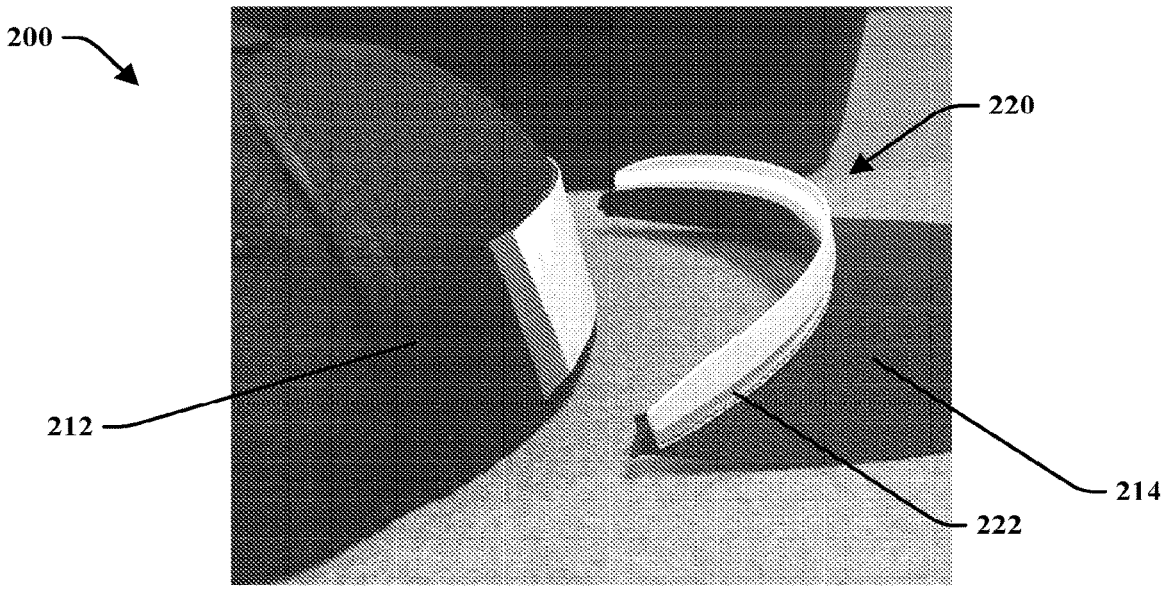
FIG. 14 is a side view of the hat system of FIG. 13.
Figure 15:
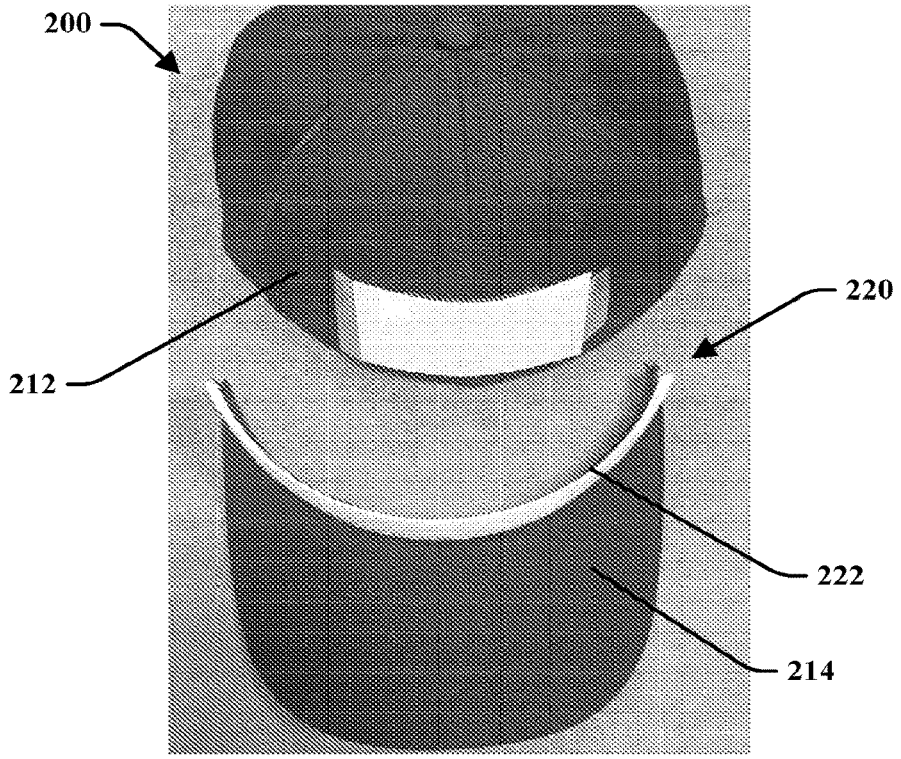
FIG. 15 is a front view of the hat system of FIG. 13.

As illustrated by FIGS. 10-12, the crown portion 124 of the connection mechanism may include an elongated receiver track 126 including a first receiving member 132 and a second receiving member 134. The receiver track 126 may extend about 1¼ inches upwardly from the bill 114. The first and second receiving members 132, 134 may extend from the headband 116 and be configured to receive and support the bill portion 122. The first receiving member 132 may be above the second receiving member 134 and both may extend along a front portion of the circumference of the crown 112. The first and second receiving members 132, 134 may each be an elongated track configured to slidingly receive a curved or rounded rail or a portion of a curved or rounded rail or wire member. The first receiving member 132 includes a slot opening along an inwardly facing portion thereof. The second receiving member 132 includes a slot opening along a bottom facing portion thereof. The slot openings may be continuous along the receiving member or may include a blocked portion to prevent further relative sliding.

The bill portion 122 of the connection mechanism 120 may include an elongated brim rail portion 140 that extends upwardly from the front edge of the bill 112. The bill portion 122 may include a first rail member 142 above a second rail member 144 that are configured to be slidingly attached to the crown portion 124 of the connection mechanism 120. The brim rail portion 140 and the first and second rail members 142, 144 may extend along the width of the bill 114 or at least a portion of the width of the bill 114. The first rail member 142 may be positioned directly above the second rail member 144 as the first rail member 142 extends transversely from the brim rail portion 140 and the second rail member 144 extends upwardly from the bill 114. In this embodiment, the first rail member 142 is attached to the elongated brim rail portion 140 and the second rail member 144 is attached to the bill 114 such that the first rail member 142 is slidingly received within the first receiving member 132 and the second rail member 144 is received within the second receiving member 134. A portion of the first and second rail members 142, 144 may fit within the slot openings of the respective first and second receiving members 132, 134. The first and second rail members 142, 144 may be about 1/16 inches in diameter.

Soft padding or other fabric 146 may be positioned along the brim rail portion 140 of the bill portion 122 to abut against the head of the wearer.

FIGS. 13-26 illustrate an alternate embodiment of the present interchangeable hat system 200. Here, a connection mechanism 220 may include various structural members to attach a bill 214 to a crown 212. In this embodiment, the hat 200 includes a crown 212 made of various types and colors of fabric and a bill 214, although it should be noted that the invention is not limited to a particular crown or bill shape or material and in fact works with any number of crown and bill shapes, conventional materials and relative rigidity, including very flexible or "floppy" crowns and brims.

Referring to FIGS. 13-21, inside the crown 212 is a headband 216 that circumscribes at least a substantial portion of the crown 212. The headband 216 may take the form of any conventional headband material such as leather or fabric or may be a full or partial interior lining for the crown 212. The headband 216 may be attached to the crown 212 along its circumference at least at a seam line by stitching, permanent adhesive or the like, as is well known in the art. The lower edges of both the crown 212 and the headband 216 preferably are hemmed along the seam line to improve appearance and to eliminate unraveling of the fabrics. In one embodiment, the headband 216 may extend up to about 14 inches about an interior circumference of the crown 212. However, the headband 116 may also extend about the entire interior circumference of the crown 112 to be fitted to a wearers head.

Figure 16:
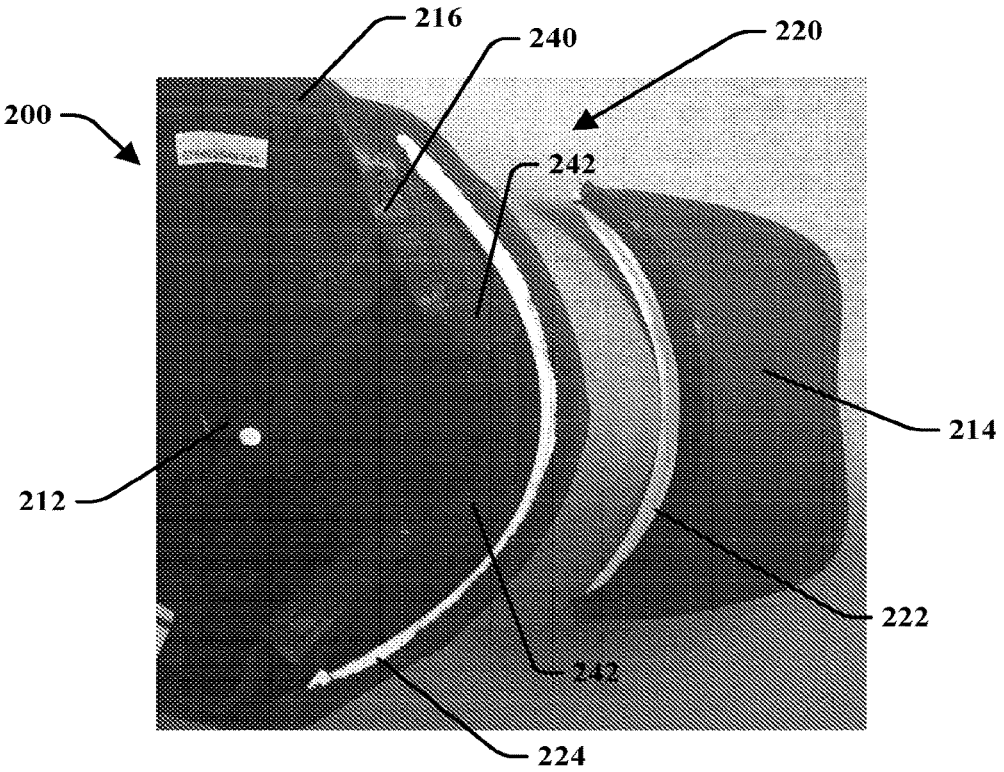
FIG. 16 is an underside view of the hat system of FIG. 13 wherein the bill is separate from the crown and a flap is in an open position.
Figure 18:
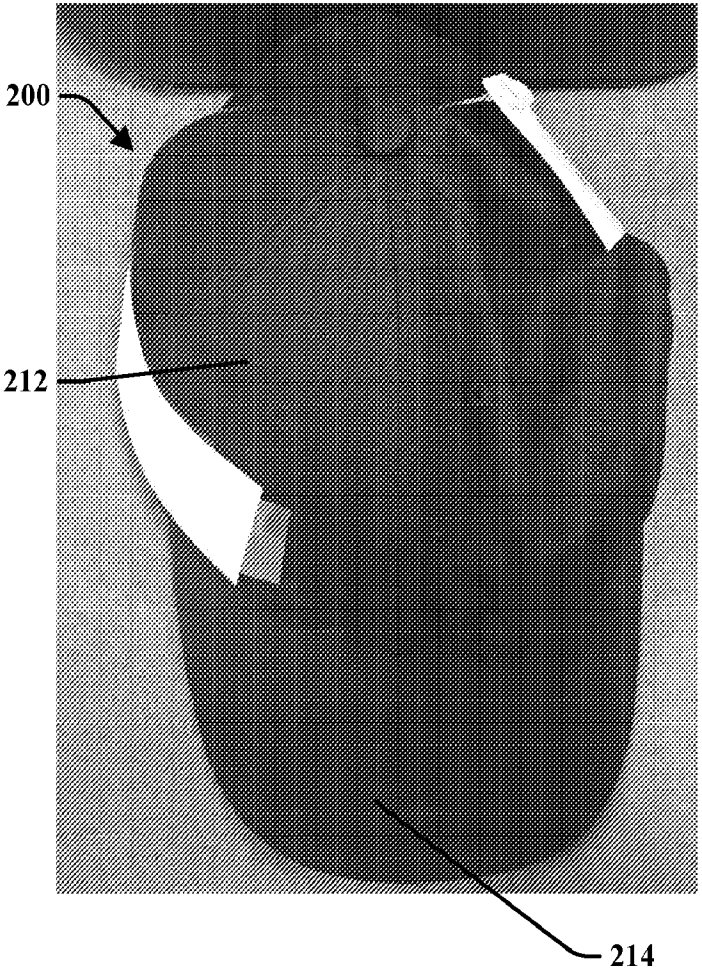
FIG. 18 is a top view of the hat system of FIG. 13 wherein the bill is at least partially attached to the crown.
Figure 17:
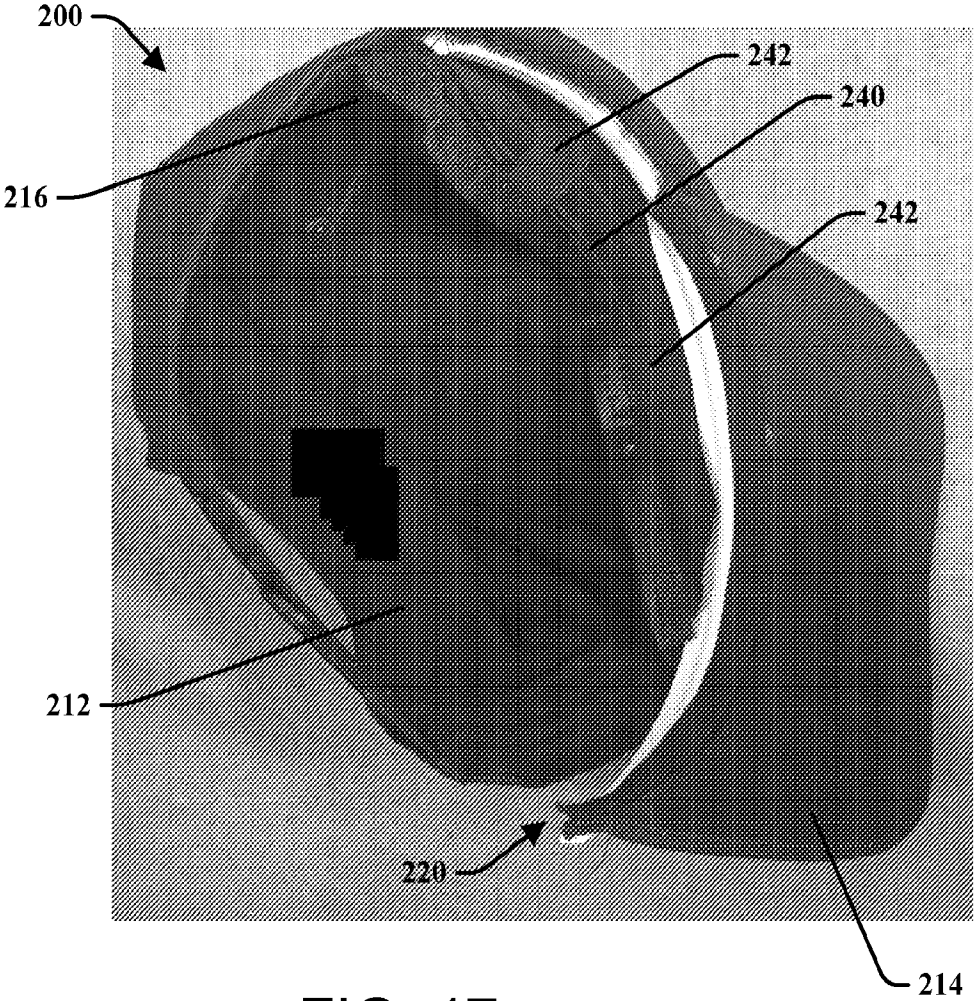
FIG. 17 is an underside view of the hat system of FIG. 13 wherein the bill is at least partially attached to the crown.
Figure 19:
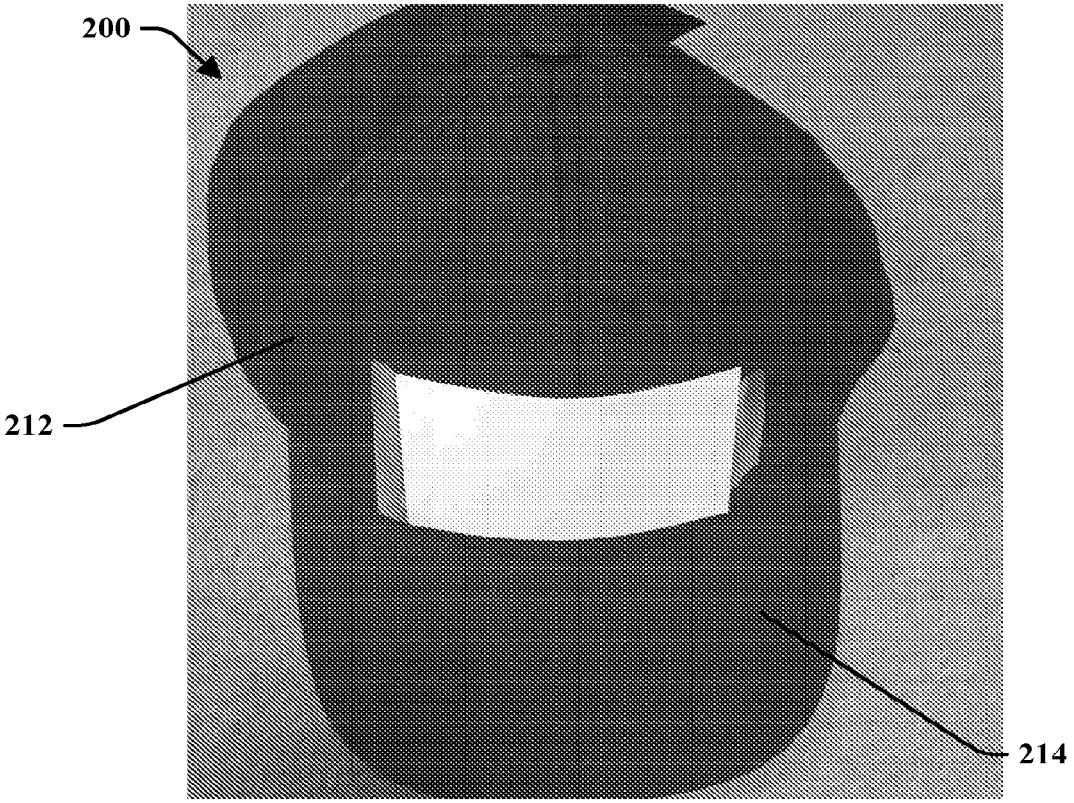
FIG. 19 is a top view of the hat system of FIG. 13 wherein the bill is attached to the crown.
Figure 20:
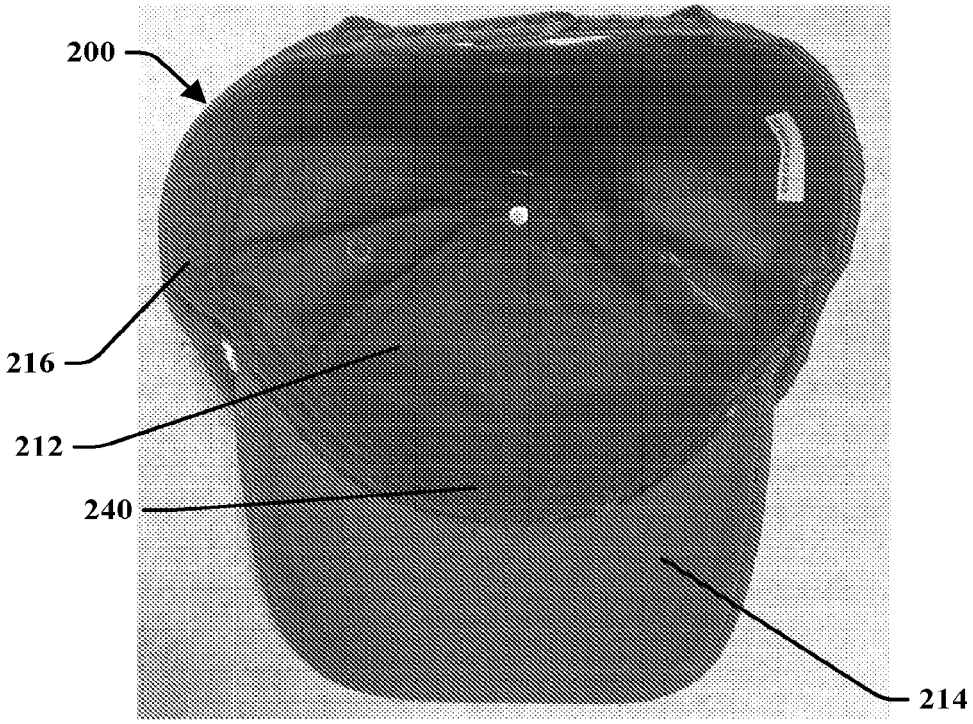
FIG. 20 is an underside view of the hat system of FIG. 13 wherein the bill is attached to the crown and the flap is in a closed position.
Figure 21:
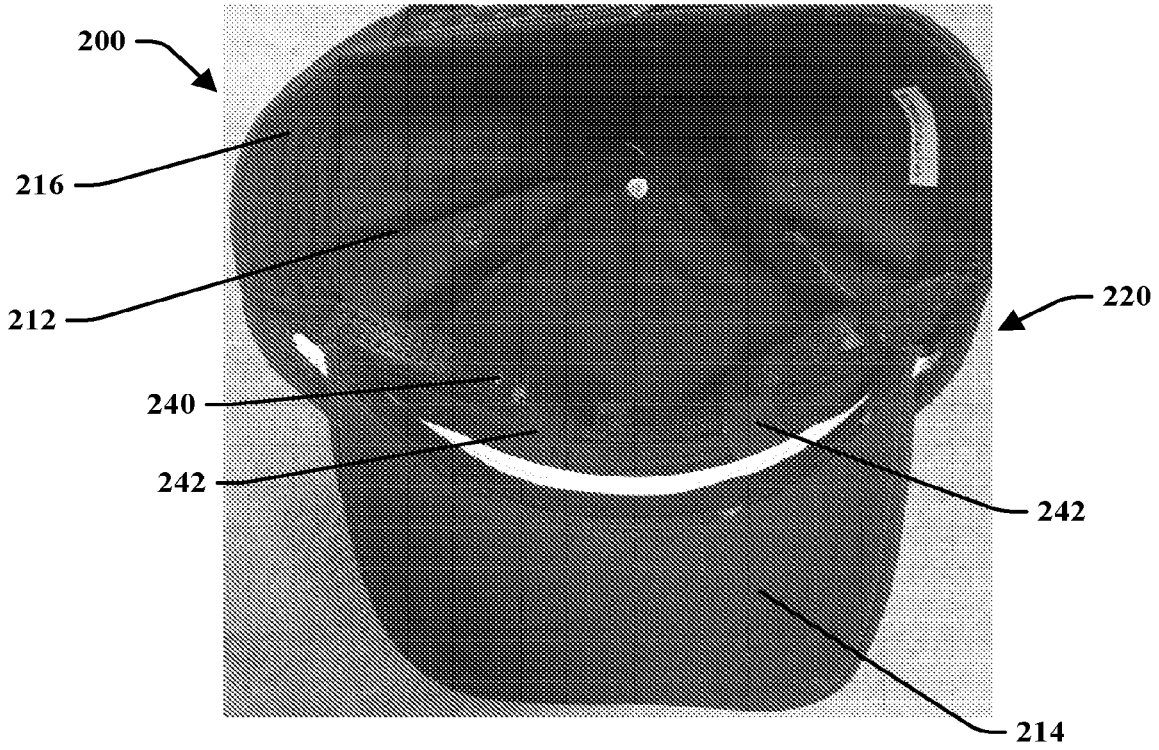
FIG. 21 is an underside view of the hat system of FIG. 13 wherein the bill is attached to the crown and the flap is in the opened position.

Generally, the headband 216 extends within a cavity defined by the crown 212 from the lower edge such that the headband 216 and crown define a slight accessible space there between. As illustrated by FIG. 16, a portion of the headband 216 includes a flap 240 along a front portion of the crown 212 that can be placed in an open position and a closed position. In this embodiment, a connection mechanism 220 is provided along the front portion of the crown 212 and a portion of the bill 214 according to the present disclosure. The connection mechanism 220 may include a bill portion 222 and a crown portion 224. The crown portion 224 may be attached to the crown 212 within an assessable space defined between the crown 212 and the flap 240 of the headband 216. The flap 240 may extend along the front portion of the crown 212 such that it includes a length that is longer than the crown portion 224 as it extends along the crown 212. The bill portion 222 of the connection member 220 may be attached to the bill 214 and extend in a general transverse and upward direction from a front edge of the bill 214. The crown portion 224 may extend inwardly from the headband 216 towards the cavity defined by the crown 212. The connection mechanism 220 may be generally rounded relative to the conventional shapes of baseball hat crowns and bills to allow for a comfortable fit on the head of the wearer. The headband 216 may be reinforced with additional fabric, threads, seams, or ridges to provide structural support to the connection mechanism 220. Additionally, the headband 216 may include retaining straps 242 that are attached to the crown 212 and the headband 216 to allow the flap 240 to pivot from the open position to the closed position while providing structural stability to the headband 216 relative to the crown 213 to provide comfort for the wearer.

The bill portion 222, and the crown portion 224 may extend about a portion of the circumference of the crown 212. In one embodiment, the connection mechanism 220 extends about 7 inches along the circumference of the crown 212 while the headband 216 extends about 3.5 inches from either side of the connection mechanism 220. Additionally, the flap 240 may extend up to about 2 inches from either side of the connection mechanism 220 or more particularly about 1 inch from either side.

Figure 22:
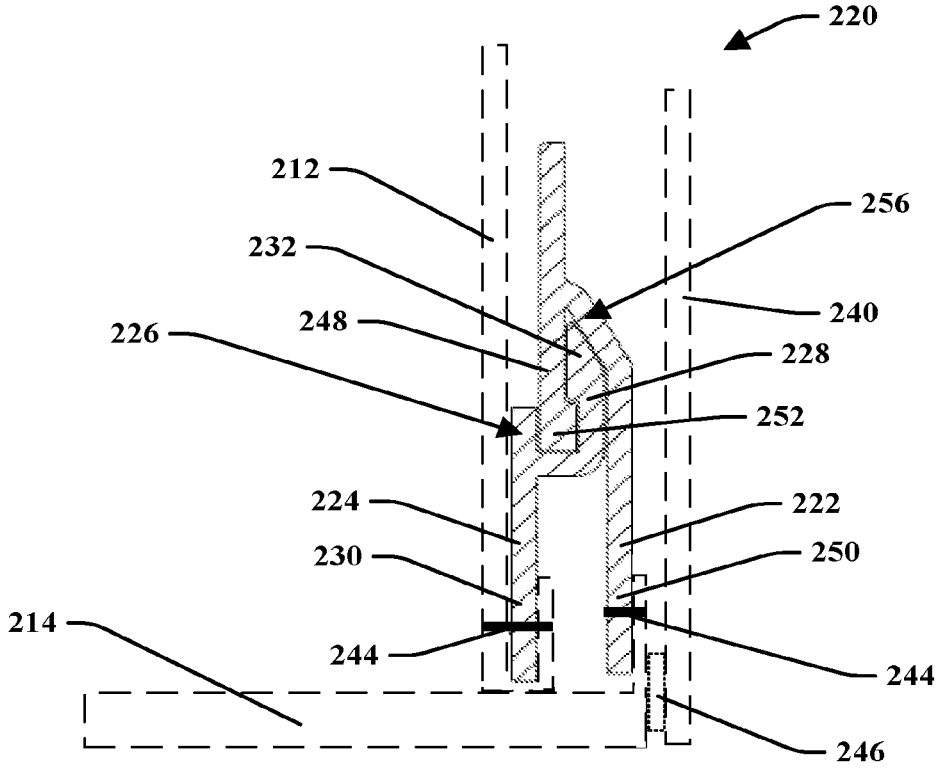
FIG. 22 is a cross sectional view of a connection mechanism in accordance with an embodiment of the present disclosure.

FIG. 22 illustrates a cross sectional view of the connection mechanism 220 with the bill portion 222 and the crown portion 224 as they are slidingly attached to one another. Here, dashed lines are provide an illustration as to illustrate the connection mechanism 220 as it may be attached to the crown 212 and bill 214. The connection mechanism 220 includes a curved or rounded shaped that includes a slender profile that may be placed within the crown 212. The slender profile allows for the connection mechanism 220 to be utilized with conventional hats, such as baseball caps, without reducing aesthetic appearance or causing discomfort to the wearer. The connection mechanism 220 also provides structural stability to allow the bill to extend generally perpendicular to the head of the wearer as traditional hats are worn while also being interchangeable.

Figure 24A:
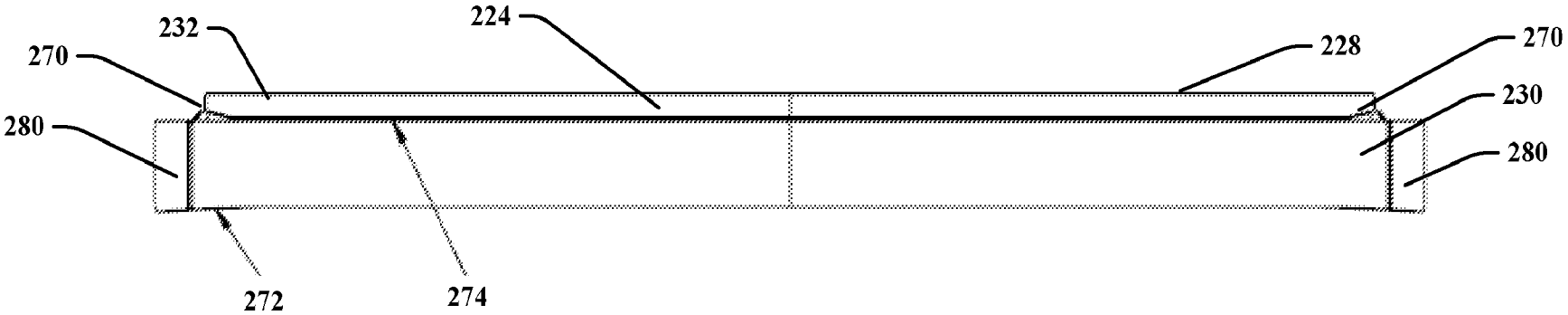
FIG. 24A is a front view of a crown portion of the connection mechanism in accordance with the embodiment of FIG. 22.
Figure 24B:
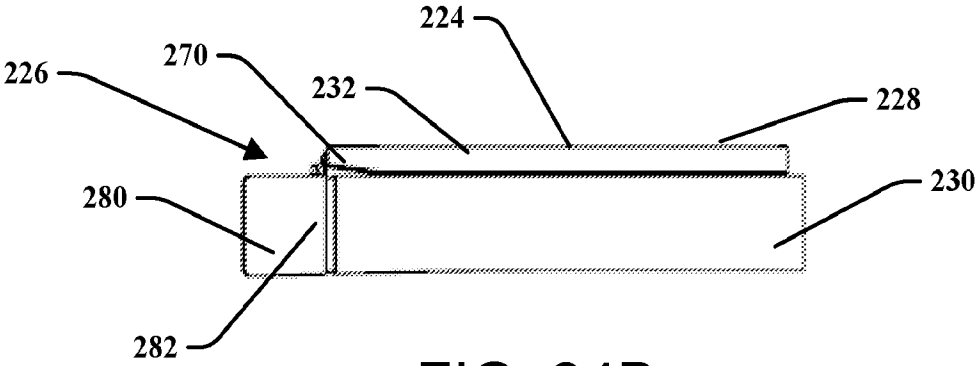
FIG. 24B is a partial front view of the crown portion of the connection mechanism in accordance with the embodiment of FIG. 22.

The crown portion 224 of the connection mechanism 220 may include an attachment member 230 that attaches to within the headband 216 of the crown 212 and an arm 228 that extends from an attachment member 230. The attachment member 230 may be attached to the crown 212 with threads 244 sown therein as the attachment member may include a series of predefined holes to receive the thread 244. However, this disclosure contemplates that other forms of attachment may be utilizes such as mechanical fasteners, adhesives, or the like. The arm 228 and the attachment member 230 define a first receiver track 226 for slidingly receiving and retaining the bill portion 222. The arm 228 may include a bead portion 232 which may extend along at least a portion of the length of the crown portion 224. The bead 232 may extend along the entire length of the arm 228 or may include a plurality of beads that generally form a shoulder to be received by the bill portion and be retained therein. As illustrated by FIGS. 24A and 24B, the crown portion 224 may include an elongated radial profile that extends about the front portion of the crown 212 to generally conform about the head of a wearer. The elongated profile of the crown portion 224 is a generally slender or thin profile shape.

The bill portion 222 of the connection mechanism 220 may include an attachment portion 250 that attaches to and extends upwardly from the bill 214 and a wall 248 that extends from the attachment portion 250. The attachment portion 250 may be attached to the bill 214 with threads 244 sown therein as the attachment portion may include a series of predefined holes to receive the thread 244. However, this disclosure contemplates that other forms of attachment may be utilizes such as mechanical fasteners, adhesives, or the like. The wall 248 and the attachment portion 250 may define a second receiver track 256 for slidingly receiving and retaining the arm 228 of the crown portion 224. The wall 248 may include a bead 252 which may extend along at least a portion of the length of the bill portion 222. The bead 252 may extend along the entire length of the wall 248 or may include a plurality of bead protrusions that generally form a shoulder to be received by the crown portion and be retained therein. The elongated profile of the bill portion 222 is a generally slender or thin profile shape.

FIG. 22 also illustrates the flap 240 in the closed position. In one embodiment, a fastener 246 may be provided between the bill 214 and the flap 240 to retain the flap in the closed position as the flap 240 may abut against the head of the wearer. The fastening surface 246 may be hook and loop type of material that may be attached to both the bill 214 and the flap 240 to operatively attach the flap 240 over the connection mechanism 220 in the closed position.

Figure 23A:
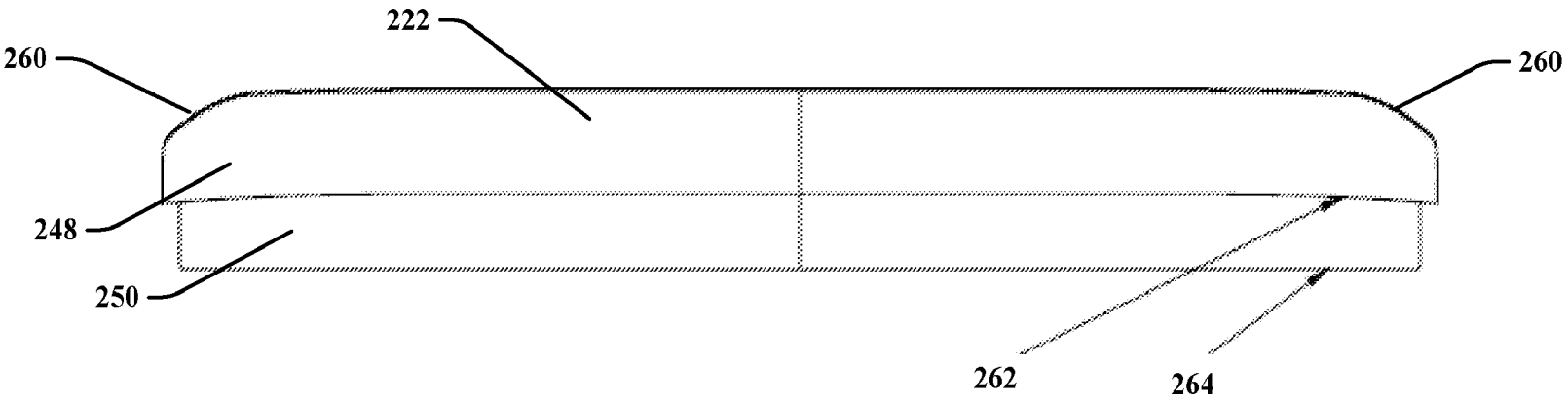
FIG. 23A is a front view of a bill portion of the connection mechanism in accordance with the embodiment of FIG. 22.
Figure 23B:
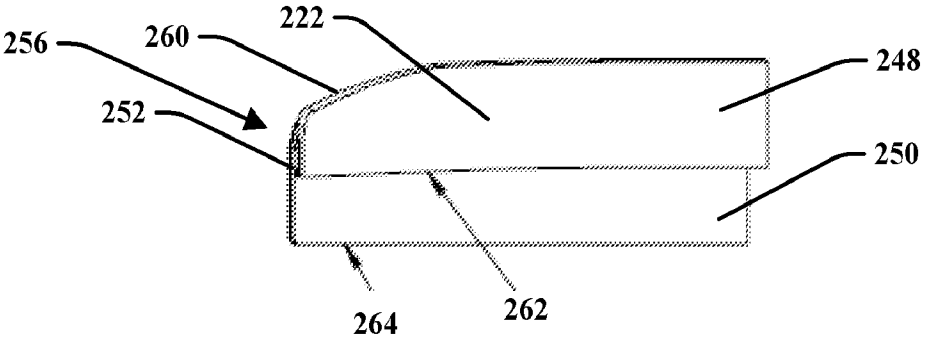
FIG. 23B is a partial front view of the bill portion of the connection mechanism in accordance with the embodiment of FIG. 22.

As illustrated by FIGS. 23A and 23B, the bill portion 222 may include an elongated radial profile that extends about the bill 214 to generally conform with the shape of the crown 212 and the shape of the head of the wearer. FIG. 23A illustrates that the profile of the bill portion 222 may include a tapered edge 260 along either ends of the bill portion 222. Also, in another embodiment, the wall 248 of the bill portion 222 may include a downwardly tapered edge 262 along either ends thereof. These tapered edges 260, 262 may assists to align the bill portion 222 with the crown portion 224 of the connection mechanism 220 when the bill 214 is slidingly attached to the crown 212. Notably, the attachment portion may include a profile shape 264 that is generally flat along the bottom of the bill portion 222.

Figure 25:
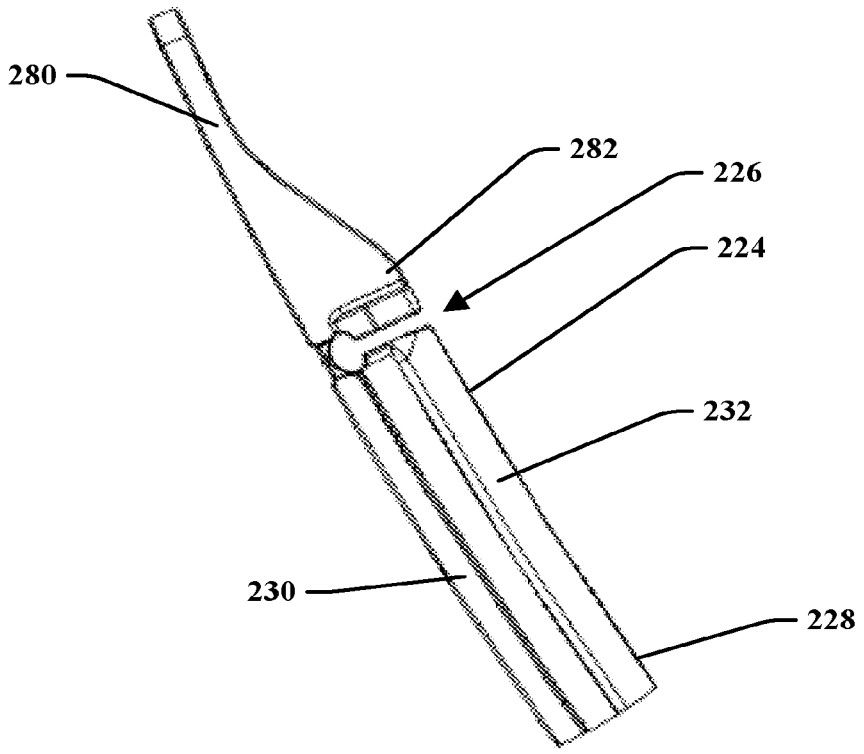
FIG. 25 is an enlarged bottom view of the crown portion of the connection mechanism in accordance with the embodiment of FIG. 22.

As illustrated by FIGS. 24A and 24B, the crown portion 224 may include an elongated radial profile that extends about the crown 212 to generally conform with the shape of the head of the wearer. FIG. 24A illustrates the profile that is to face the inner lining of the crown 212. The bead portion 232 of the arm 228 may include a tapered edge 270 along either ends of the crown portion 224. Also, in another embodiment, the attachment member 230 may include a downwardly tapered edge 272 along either ends thereof. These tapered edges 270, 272 may assists to align the bill portion 222 with the crown portion 224 of the connection mechanism 220 when the bill 214 is slidingly attached to the crown 212. Notably, the bead portion 232 may include a profile shape 274 that is generally flat along the remaining portion of the arm 228. A hinge member 280 positioned along either or both ends of the crown portion 224. The hinge member 280 may be a separate piece or may be integral to the crown member 224. The hinge member 280 may be received within between the headband 216 and the crown 212 and may bias inwardly and outwardly to act as an operable stop to prevent sliding lateral movement between the bill portion 222 and the crown portion 224. As illustrated by FIG. 25, the hinge member 280 may include a ridge 282 that operably covers the first receiver track 226 defined by the arm 228 and the attachment member 230 of the crown portion 224. The hinge member 280 may be biased open or closed relative to the first receiver track 226 to allow the crown portion 224 to slidingly receive and retaining the second receiver track 256 of the bill portion 222. When the hinge member 280 is in the open position, the first receiver track 226 and second receiver track 256 may be slidable relative to one another. When the hinge member 280 is in the closed position, the first receiver track 226 and the second receiver track 256 may be prevented from slidably moving relative to one another.

Figure 26A:
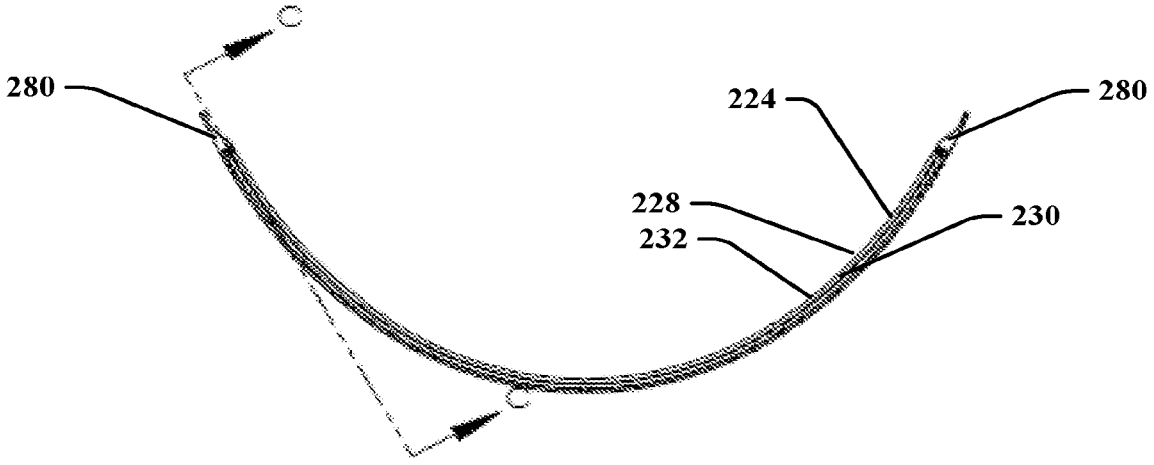
FIG. 26A is a bottom view of the crown portion of the connection mechanism in accordance with the embodiment of FIG. 22.
Figure 26B:
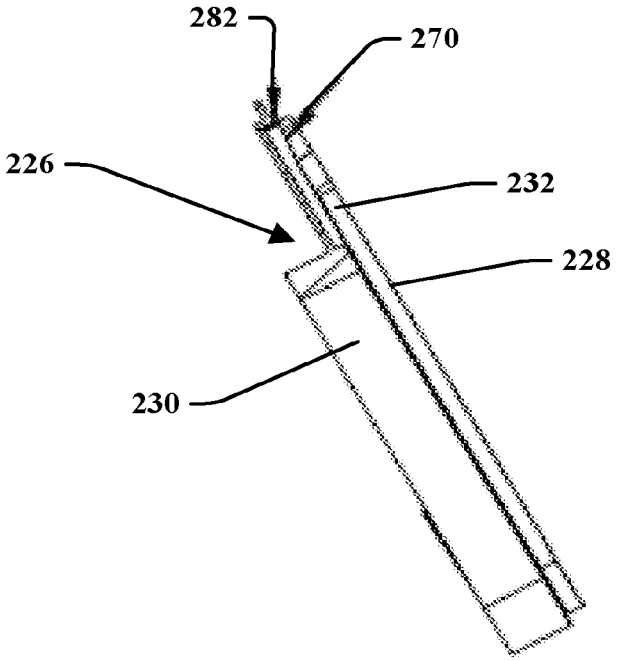
FIG. 26B is a cross sectional view of the crown portion of FIG. 26A along line C-C.

FIG. 26A illustrates a bottom view of the elongated radial profile of the crown portion 224 with axis C-C. FIG. 26B illustrates a cross sectional view of the crown portion 224 through axis C-C. Here, the ridge 282 and tapered edge 270 of the bead portion 232 are shown relative to the attachment portion 230 and arm 228.

The hat system allows for a wearer to interchange a crown portions with other bill portions to change the appearance and design of the hat and create different designs or arrangements. Thus, wearers could change bills or crowns to change color combinations, to change from a traditional cap to a visor.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The features of each embodiment described and shown herein may be combined with the features of the other embodiments described herein. The claims as follows are intended to include all modifications and alterations insofar as they come within the scope of the claims or the equivalent thereof.

Having thus described the invention, I claim:

1. A hat system comprising:

a crown;

a bill; and a connection mechanism between the bill and the crown, the connection mechanism includes a bill portion and a crown portion wherein the bill portion includes a channel and the crown portion includes at least one rail wherein the channel is configured to slidingly receive the rail to connect the bill to the crown, wherein the bill portion includes a first rail member and a second rail member, and wherein the crown portion includes a first receiving member and a second receiving member wherein the first receiving member slidingly receives the first rail member and the second receiving member slidingly receives the second rail member to connect the bill to the crown.

2. The hat system of claim 1, wherein the rail includes a plurality of rail heads positioned in elongated alignment along the bill portion.

3. The hat system of claim 1 further comprising:

an elongated slot opening along a side portion of the first receiving member; and an elongated slot opening along a bottom portion of the second receiving member such that the first and second rail portions are supported at least partially within the elongated slot openings.

* * * * *